US007246812B1

(12) United States Patent
Ayliffe

(10) Patent No.: US 7,246,812 B1
(45) Date of Patent: Jul. 24, 2007

(54) CROSS-COUNTRY SKI BINDING

(76) Inventor: Harold E. Ayliffe, 1036 Station Loop Rd., Park City, UT (US) 84098

( * ) Notice: Subject to any disclaimer, the term of this patent is extended or adjusted under 35 U.S.C. 154(b) by 0 days.

(21) Appl. No.: 11/055,161

(22) Filed: Feb. 10, 2005

Related U.S. Application Data

(60) Provisional application No. 60/543,528, filed on Feb. 11, 2004.

(51) Int. Cl.
*A63C 9/00* (2006.01)

(52) U.S. Cl. ..... 280/615; 280/619; 280/621

(58) Field of Classification Search ..... 280/615, 280/611, 613, 614, 619, 620, 621
See application file for complete search history.

(56) References Cited

U.S. PATENT DOCUMENTS

| | | | | | |
|---|---|---|---|---|---|
| 3,863,942 | A * | 2/1975 | Burger | ..... | 280/621 |
| 4,273,355 | A * | 6/1981 | Storandt | ..... | 280/614 |
| 4,887,833 | A * | 12/1989 | Bailey | ..... | 280/615 |
| 5,499,838 | A * | 3/1996 | Hauglin et al. | ..... | 280/615 |
| 5,560,633 | A * | 10/1996 | McGowan | ..... | 280/614 |
| 5,669,622 | A * | 9/1997 | Miller | ..... | 280/615 |
| 5,823,563 | A * | 10/1998 | Dubuque | ..... | 280/615 |
| 5,893,576 | A * | 4/1999 | Hauglin | ..... | 280/621 |
| 5,947,507 | A * | 9/1999 | Quintana et al. | ..... | 280/615 |
| 6,234,514 | B1 * | 5/2001 | Dubuque | ..... | 280/619 |
| 6,308,979 | B1 * | 10/2001 | Ludlow | ..... | 280/615 |
| 6,467,796 | B1 * | 10/2002 | Weltman et al. | ..... | 280/615 |
| 2003/0006585 | A1 * | 1/2003 | Ayliffe | ..... | 280/615 |
| 2003/0098570 | A1 * | 5/2003 | Ayliffe | ..... | 280/624 |
| 2003/0155742 | A1 * | 8/2003 | Riedel et al. | ..... | 280/615 |
| 2005/0212263 | A1 * | 9/2005 | Steffen et al. | ..... | 280/619 |

* cited by examiner

*Primary Examiner*—J. Allen Shriver
(74) *Attorney, Agent, or Firm*—Brian C. Trask

(57) ABSTRACT

A ski binding of the cross-country type in which a ski boot's heel may be elevated with respect to the ski's top surface while in the act of skiing. The binding includes a toe piece associated with a heel retainer through a spring-biased linkage. A linkage typically includes a pre-loaded compression spring mounted external to a core element. A preferred linkage includes a plurality of rigid link elements defining plurality of intermediate pivot axes between an anchor and the heel retainer. Certain preferred linkage systems permit unfettered boot flexion, but transversely maintain the heel retainer in a zone over the ski to facilitate step-in engagement. Desirably, the core is adjustable along the linkage, to change a spacing between the toe piece and heel retainer independent of spring pre-load. Preferred embodiments of the binding a rear frame adapted to permit step-in engagement of a ski boot. Certain frames may carry a televator. A frame may function as a rear shim to permit adjusting a binding to fit boots of different sizes without necessitating adjustment of the position of a rear shim installed on a ski.

19 Claims, 11 Drawing Sheets

CROSS-COUNTRY SKI BINDING

RELATED APPLICATIONS

This application claims the benefit under 35 U.S.C. 119(e) of the filing date of Provisional Application Ser. No. 60/543,528, filed Feb. 11, 2004, for "CROSS COUNTRY SKI BINDING".

BACKGROUND

1. Field of the Invention

This invention relates to sporting goods used in skiing. It is particularly directed to a ski binding operable to maintain a toe of a ski boot in association with a ski while permitting a heel of the ski boot to elevate with respect to a top surface of the ski.

2. State of the Art

Bindings for telemark skis and cross-country skis provide an interface between a ski boot and a ski that permits a skier to elevate the heel of a ski boot with respect to the top surface of the ski while skiing. Such bindings typically have a toe piece that holds a forward portion of a boot in pivoting relation to an axis disposed transverse to the ski. One such toe piece binding, which has become popular, is the 75 mm binding. The 75 mm binding has a toe piece which includes 3 retaining pins. The retaining pins fit into corresponding holes in the sole of the ski boot toe. A clamp mechanism holds an extended sole of the boot's toe in place over the retaining pins. While generally a very effective toe binding, the 75 mm binding undesirably permits a skier's heel significant freedom to slip laterally with respect to the ski.

A cable, or other linkage, extending from the binding toe piece for engagement with a heel portion of a ski boot has been used to increase heel stability in some cross-country type bindings. The linkage can hold the toe of a ski boot firmly in place in the toe piece. The cable or linkage typically locates a toggling heel piece in engagement with structure at the heel of a ski boot. In general, a skier must manually actuate the heel piece to engage a ski boot in the binding.

One commercially available cross-country binding is disclosed in U.S. Pat. No. 5,947,507 to Quintanna et al. The disclosed binding has an exposed spring located in front of a skier's foot, and a toe piece with a divided toe bar. The binding disclosed by Quintanna et al. also has an under-boot linkage to a heel piece arranged continuously to increase load on a boot toe with a corresponding increase in heel lift. The compression force applied, by the heel piece on the back of an installed ski boot in a heel-down position, is generated entirely by displacement of the toe spring as the heel lever is engaged.

A ski binding having a multileaved linkage between a toe piece and a heel retainer is disclosed by Bailey, in U.S. Pat. No. 4,887,833, issued Dec. 19, 1989. Bailey's disclosed binding includes an underfoot hinged rigid linkage to improve lateral stability of a ski boot with respect to the toe piece when the boot is in a raised-heel position. The linkage includes an anchor pivot axis and a single intermediate pivot axis disposed between a toe piece and a heel piece. The linkage further includes a pair of exposed compression springs disposed to provide a biasing force to urge a ski boot toe into engagement with the toe piece. No adjustment effective to accommodate different boot lengths without changing a compression of the exposed springs is illustrated.

A ski binding of a hybrid cross-country/alpine design and having spring elements mounted under a skier's foot is disclosed by Harold E. Ayliffe in application Ser. No. 09/997,842, published May 29, 2003. The disclosed binding has exposed springs carried by an underfoot carriage. The carriage is spaced from a toe piece by a plurality of cables arranged in an "X" pattern to provide enhanced stability of a skier's heel. A heel piece carried by the carriage is configured to provide step-in capability and a safety release. In use as an alpine binding, the carriage can be locked in place with respect to a ski to resist elevation of a skier's heel.

While certain available cross-country bindings are workable, it would be an improvement to provide a binding that is reliable, light in weight, and that better maintains a ski boot in lateral registration with a ski when the boot is in a heel-elevated position. Another advance would provide one or more pre-loaded spring assemblies to reduce a displacement distance required during assembly of a heel retainer onto a boot heel to generate a biased load effective to maintain a secure engagement between a boot toe and a toe piece of a binding. A further advance would provide a binding capable of accommodating displacement of a ski boot to a maximum heel-up position without fully compressing spring elements and thereby undesirably generating large spike loads between the binding components and the ski boot. A still further advance, for certain types of skiing, would provide a ski binding capable of providing significant and controlled loads on a ski boot effective to urge the ski boot heel from a heel-up position toward engagement with the top of the ski.

BRIEF SUMMARY OF THE INVENTION

The present invention provides an apparatus for use during skiing, and operable to hold a ski boot in association with a ski while permitting the skier to elevate a heel of the ski boot with respect to a top surface of the ski. Preferred embodiments include a biasing linkage assembly disposed in association between a toe piece and a heel retainer. The toe piece is arranged to hold a toe portion of a ski boot in registration with respect to a ski. The heel retainer is configured and arranged for engagement with structure associated with a heel portion of a ski boot. The linkage assembly is adapted to bias the heel retainer effective, when the ski boot is installed in the binding, to urge the toe portion of the ski boot toward contact with structure associated with the toe piece.

Certain highly preferred embodiments of a linkage assembly include a pre-loaded spring assembly. A preferred spring assembly includes a core adapted for attachment to structure of the linkage assembly, with a first compression spring mounted substantially coaxially with, and external to, the core and disposed in a state of compression prior to installation of a ski boot into the binding. Some bindings constructed according to principles of the invention also include one or more additional compression spring mounted substantially coaxially with, and external to, the core. In such cases, desirably the adjacent compression spring are of opposite hand to promote smooth displacement. In certain embodiments, an amount of pre-load in the first compression spring is fixed upon factory assembly of the ski binding. In other embodiments, an amount of pre-load in the first compression spring is user adjustable.

Desirably, the core is attached to tension structure of the linkage assembly operably to vary a spacing between the heel retainer and the toe piece without simultaneously compressing a biasing spring associated with the linkage. An advantage inherent in certain embodiments of the invention is the ability to adjust the binding to accommodate ski boots of different size without necessitating an adjustment in position of a rear shim element installed on the ski for disposition of the rear shim under the heel of a ski boot Often, the core is configured and arranged in harmony with structure of the linkage assembly operably to urge an alignment of an axis of a linkage biasing element with the direction of a load applied by the tension structure to decrease wear on the associated components.

Particularly desirable arrangements forming a heel retainer include a frame carrying a toggle lever configured to permit step-in installation of the ski boot. One operable such toggle lever is mounted for rotation about a pivot axis that is oriented by a spacer effective to maintain at least a minimum offset between the lever's pivot axis and a top surface of a ski on which the binding is mounted. Certain operable toggle levers include a step-in shelf arranged to interact with a heel of an entering ski boot operably to initiate rotation of the toggle lever during a step-in assembly of a binding onto a ski boot. Such toggle levers include a hold-down prong configured in harmony with the step-in shelf to engage groove structure associated with a heel area of a commercially available plastic ski boot operably to continue rotation of the toggle lever to effect over-center displacement of the hold-down prong. It can be advantageous for an orientation of the step-in shelf with respect to the hold-down prong to be user adjustable to accommodate ski boots having different sole thicknesses.

It is currently preferred to configure the biasing linkage assembly to dispose the frame in association with one or more pre-loaded spring assembly substantially under a heel portion of an installed ski boot. It is advantageous for certain structure associated with a frame to be rotatable about an alignment pivot axis to effect an automatic adjustment effective to accommodate ski boots having different sole thickness. Furthermore, preferred frames carry a climbing post operable to establish a load bearing platform for a heel of a ski boot at a location elevated from the top surface of the ski.

One preferred binding includes a linkage assembly configured and arranged to facilitate a step-in procedure by urging the heel retainer into registration within a zone over a top surface of the ski to permit direct step-in engagement of the ski boot. Such a linkage may be formed from a plurality of rigid link elements disposed to form a multileaved hinge. Such a multileaved hinge can be configured and arranged to flex about a plurality of transverse axes in harmony with a flexed boot sole, while still providing significant lateral reinforcement for an elevated boot heel. One preferred multileaved hinge linkage includes a forward tension member disposed for rotation between an anchor axis and a discrete first intermediate axis. A rigid link is disposed for rotation between the first intermediate axis and a second discrete intermediate axis. A rear tension member is then disposed for rotation about the second intermediate axis, and is associated with one or more spring cartridges. The link is effective to space apart and maintain the first and second intermediate axes in a parallel orientation. Therefore, the forward tension member, the rigid link, and the rear tension member are configured and arranged in harmony to resist transverse displacement of the heel retainer.

The invention can be embodied in a ski binding including a linkage assembly disposed in association between a toe piece and a heel retainer, where the heel retainer is configured and arranged to permit step-in engagement between the binding and a ski boot. The heel retainer desirably includes a frame carrying a toggle lever rotatably mounted on structure defining a spaced apart relationship between a pivot axis for the toggle lever and the top of the ski. Desirably, structure associated with the frame is configured to form a support surface disposed under a heel of an installed ski boot. Furthermore, such support surface optimally is spaced apart from a top surface of the ski to an elevation in harmony with an elevation of an installed toe piece. Therefore, the support surface acts as a rear shim for an installed ski boot. In preferred embodiments, the linkage system is arranged to permit adjustment of a spacing between the toe piece and frame effective to dispose the support surface at an operable position, regardless of a length of the installed ski boot. The frame may carry televator structure operable to assist a skier in climbing a steep grade. Furthermore, the frame may be rotatable about a transversely oriented alignment pivot axis to effect an automatic adjustment to accommodate a plurality of ski boots having differently sized spacing between a boot-heel bottom surface and receiving structure adapted to engage a hold-down prong of a toggle lever.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Figure 1:
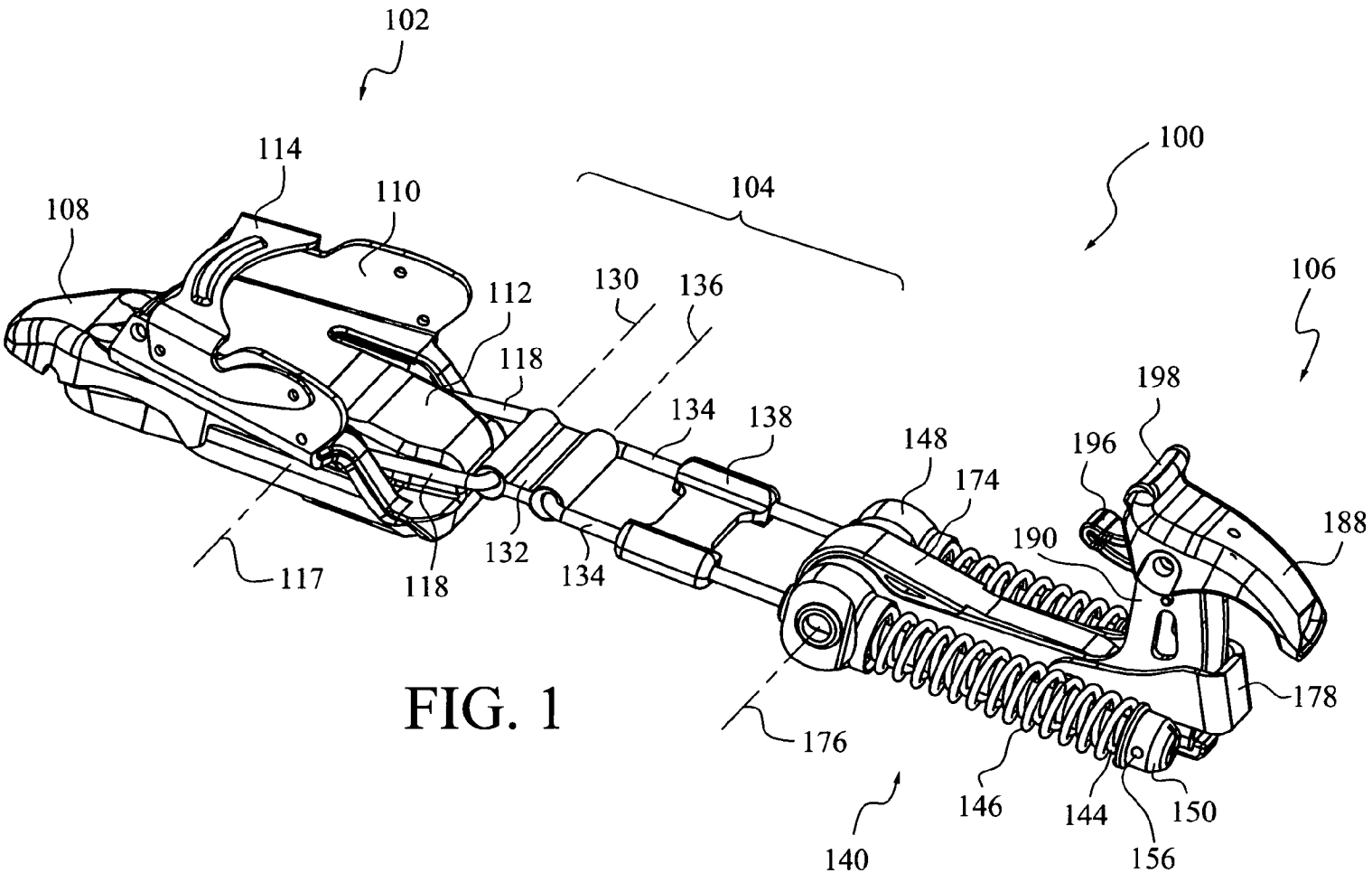
FIG. 1 is a view in perspective of a currently preferred embodiment of a cross-country type ski binding constructed according to principles of the invention.
Figure 2:
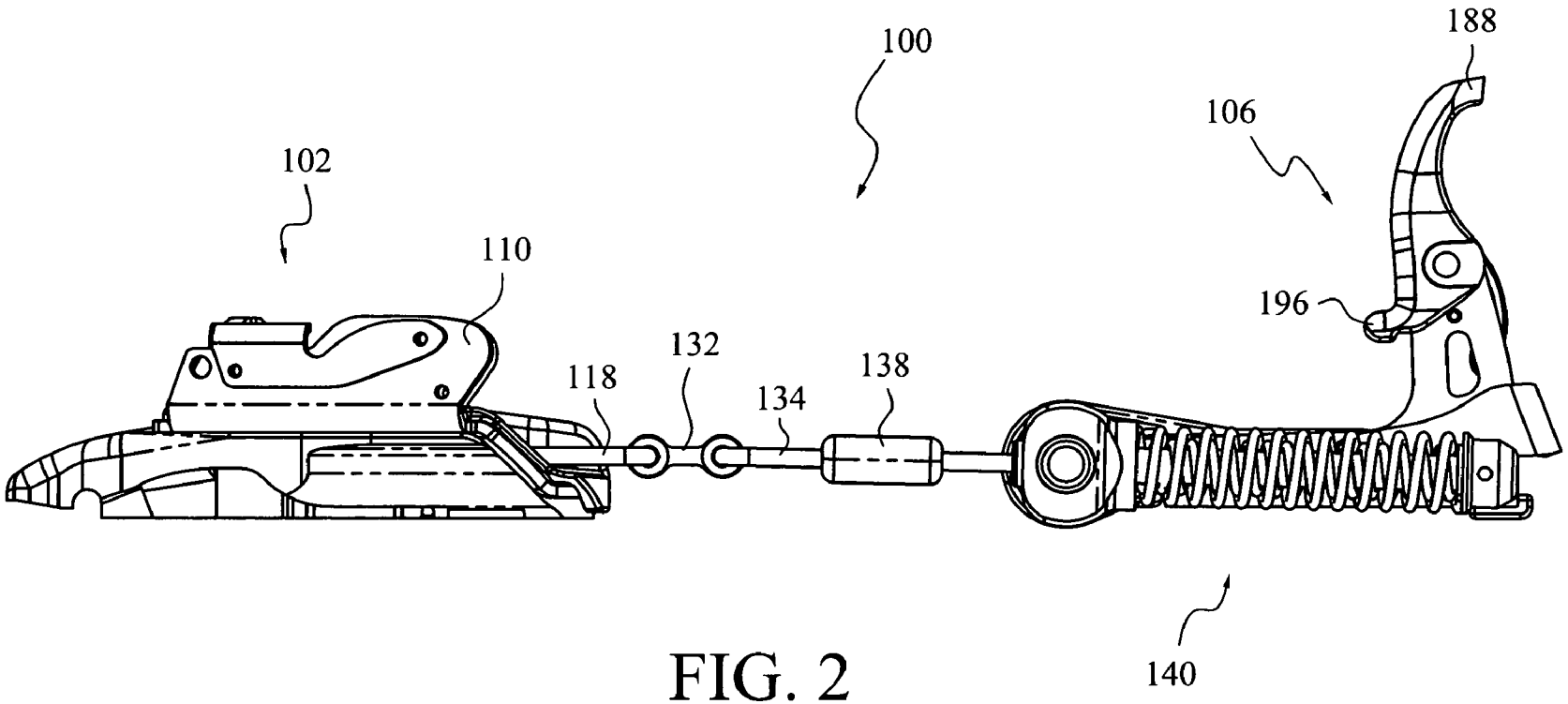
FIG. 2 is a side view of the binding of FIG. 1.
Figure 3:
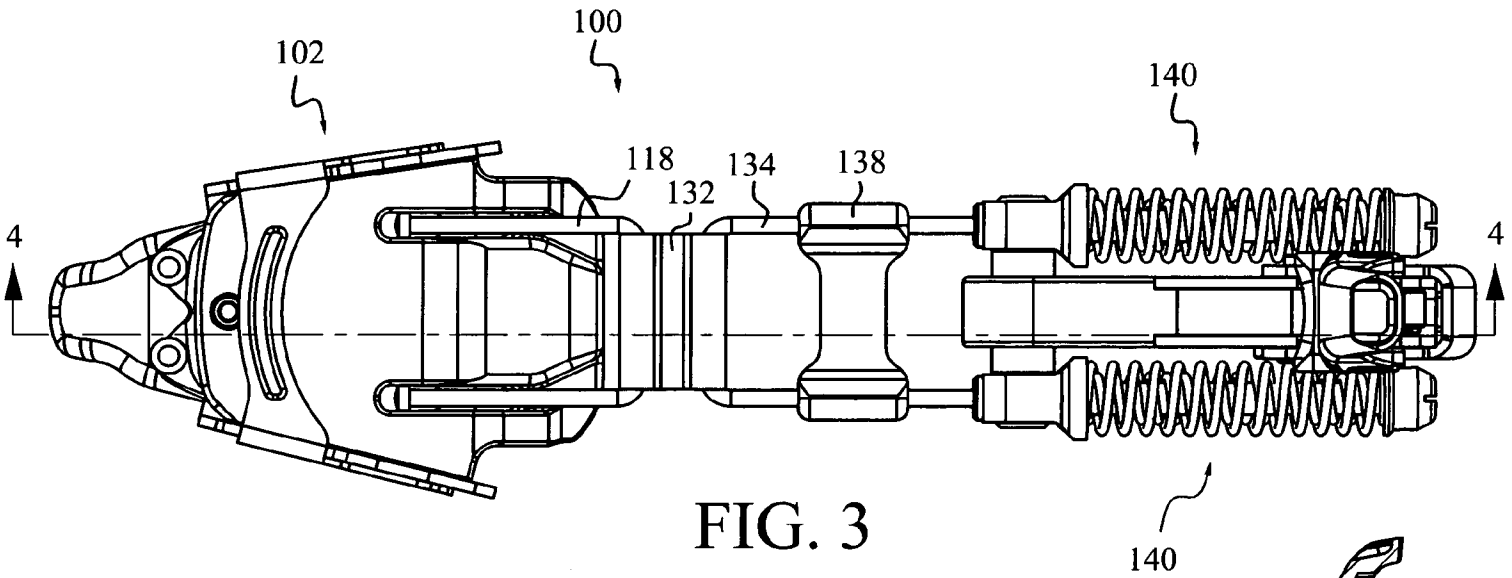
FIG. 3 is a top view of the binding of FIG. 1.
Figure 4:
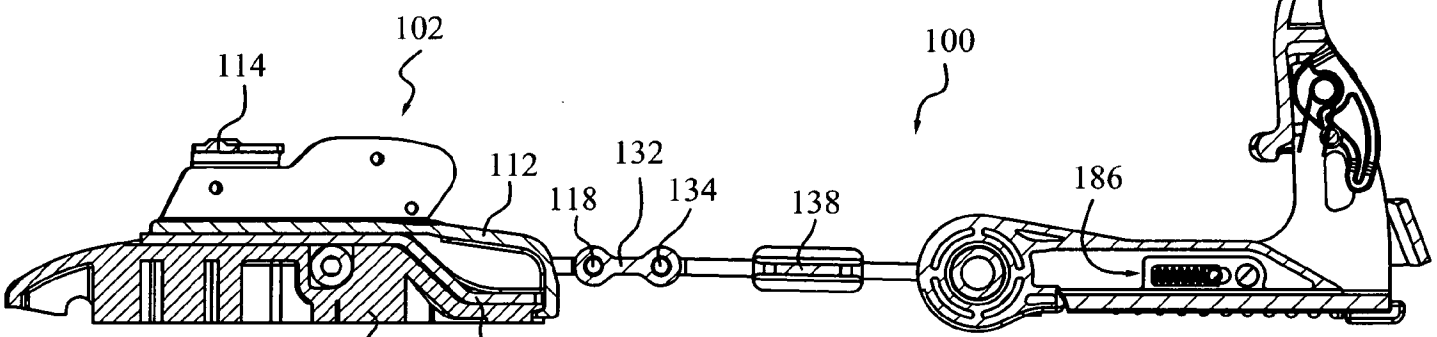
FIG. 4 is a cross-section view taken through section 4-4 in FIG. 3, and looking in the direction of the arrows.

Reference will now be made to the drawings in which the various elements of the illustrated embodiments will be given numerical designations and in which the invention will be discussed so as to enable one skilled in the art to make and use the invention. It is to be understood that the following description is only exemplary of the principles of the present invention, and should not be viewed as narrowing the claims which follow.

For purpose of this disclosure, directions are typically defined with respect to an orientation of a ski disposed on a horizontal snow surface in position for skiing. Therefore, a vertical direction is indicated by a vector originating on the snow surface, and pointing up toward the sky. A longitudinal direction is approximately parallel to a vector from the ski tip to tail. A transverse direction is oriented normal to the longitudinal and vertical directions, and is parallel to the snow surface. A forward direction is longitudinally toward the ski tip, and a rear direction is longitudinally toward the ski tail. The top surface of the ski carries the ski binding.

A currently preferred embodiment of a cross-country ski binding, generally indicated at 100, constructed according to principles of the invention is illustrated in FIGS. 1-4. FIGS. 5-9 illustrate details of certain aspects of the preferred embodiment 100. In broad terms, ski binding 100 includes a toe piece assembly, generally indicated at 102; a linkage assembly, generally indicated at 104; and a heel retainer assembly, generally indicated at 106. Illustrated toe piece assembly 102 includes a front shim 108, and a toe piece frame 110. An anti-ice cover plate 112 typically is provided to resist accumulation of ice and snow on the toe piece assembly when skiing.

It is currently preferred to fabricate the toe frame 110 from Aluminum sheet stock, and to fabricate toe bar 114 by stamping and bending a stainless steel sheet. The toe frame 110 and bar 114 are typically connected with rivets, although any other known workable construction technique may be used. It is also preferred for the toe piece frame to be extended in length along an axis of the ski, as illustrated, to spread out loading applied by a ski boot. In general, while any material capable of resisting the loads applied during skiing may be used to construct a binding, it is currently preferred that materials employed for such purpose also resist rusting.

It is within contemplation that alternative, and not illustrated, arrangements would result in an operable toe piece assembly. For example, a forward shim 108 could be incorporated into a ski, or even into an alternatively structured toe frame. Toe frame 110 can be manufactured to include an integral full-width toe bar 112, or as a pair of stub portions cantilevered transversely from opposite upstanding sides of frame 110. One operable alternative toe bar could be formed as an upstanding structure affixed at a front of the frame 110, and including a cantilevered bar portion extending rearwardly to interface with the top surface of a boot's toe sole. Certain operable toe pieces include a clamping mechanism structured to retain a boot's toe sole in registration with a number of upstanding pins. A workable toe piece must simply be able to register a toe portion of a ski boot with respect to a ski on which the binding is mounted, while permitting a heel portion of the ski boot to be elevated with respect to a top surface of the ski.

Figure 5:
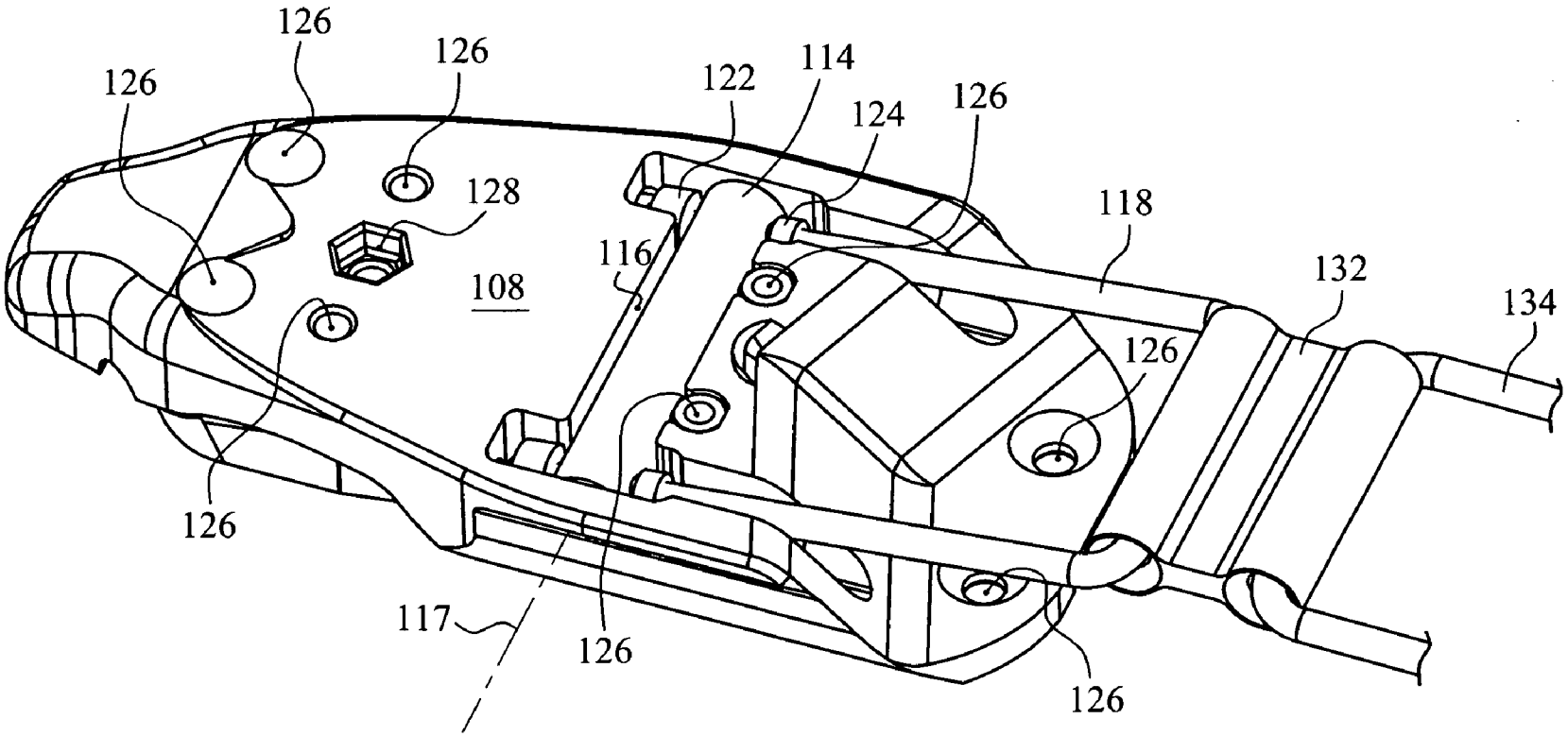
FIG. 5 is a view in perspective of a forward shim portion of the toe piece of FIG. 1.

A linkage assembly, such as linkage 104, is associated between the toe piece and heel retainer to bias a ski boot toward the toe piece. One way to associate a linkage with a toe piece is illustrated in FIG. 5. As illustrated, an anchor axle 114 is rotatably mounted in transverse slot 116 inside front shim 108. Axle 114 forms an anchor for ends of forward tension member 118. Slot 116 is sized to snugly hold axle 114 to permit rotation of axle 114 about a transverse anchor axis 117, but to resist rotation about axes disposed in longitudinal and vertical directions. Ends of forward tension member 118 extend through longitudinal slots 120, and are affixed or attached in some way to axle 114. It is currently preferred to affix forward tension member 118 to axle 114 by tightening jam nuts 122 to compress axle 114 against shoulders 124. A shoulder 124 may advantageously be formed by a second jam nut threaded into a desired location along threaded rod 118. Toe piece frame plate 110 is then installed over the axle 114 effective to trap axle 114 for rotation inside shim 108. A plurality of fasteners, not illustrated, are installed in mounting holes 126 to hold the toe piece assembly 102 on a ski. Ice shield 112 may be installed using a fastener to engage a nut trapped beneath plate 110 in socket 128.

The anchoring arrangement in the preferred embodiment 100 is arranged to resist transverse deflection of heel retainer 106, while permitting its vertical motion. It is desirable for the heel retainer 106 to be maintained in a zone over the top of the ski to facilitate step-in installation of a ski boot into the binding 100. In less desirable embodiments lacking sufficient transverse stiffness, a skier would be required to manually locate the heel retainer in position over the ski surface before stepping down to engage the binding onto the ski boot. In addition to facilitating step-in assembly, a linkage having transverse stiffness beneficially also improves lateral stiffness between the ski and the boot when the boot heel is in a raised position.

Linkage assembly 104 includes substantially rigid members arranged to resist transverse motion of the heel retainer. Linkage assembly 104 is also adapted to flex about a plurality of distinct transverse axes to form a shape approximately in harmony with the shape of a flexed ski boot. Forward tension member 118 is pivotally connected about transversely disposed first intermediate axis 130 to link 132. Link 132 is pivotally connected to tension member 134 at transversely disposed axis 136. U-shaped tension members 118, 134 are currently formed from spring steel rods that are slid into receiving bores in Aluminum link 132. After the steel members 118, 134 are slid into reception in the link 132, they are bent to final shape using a die. The number of rotating link elements (and intermediate pivot axes), may be increased to form a more precise curved shape in a deflected linkage 104. However, it is currently believed that the illustrated linkage 104 embodies an effective trade-off between achievable deflected shape, manufacturing cost, complexity, and transverse rigidity.

A brace 138 may be included in certain embodiments of a binding 100. Brace 138 generally functions to stiffen tension member 134, and may provide reinforcement against loads imparted from skiing-related activities, such as crashes. A brace 138 may be particularly beneficial for embodiments of a binding 100 used in combination with large ski boots. Illustrated brace 138 is a two component assembly that is threaded into position along tension member 118, and snapped into an assembly. A clamshell arrangement that is assembled to grip and reinforce a midspan portion of tension member 134 would also be workable. Another alternative brace includes a cross-spanning element with a pair of bores sized to slide along shafts of tension element 118 and held in place by jam nuts. A workable brace 138 can be manufactured from plastic, Aluminum, titanium, or other similarly structurally supportive materials.

Desirably, a linkage maintains a biasing load on a ski boot while permitting a change in the spacing between a toe piece 102 and a heel retainer 106, to accommodate the inherent change in such spacing associated with lifting and lowering the ski boot's heel while skiing. Illustrated linkage 104 includes a pair of spring cartridges, generally indicated at 140, effective to urge a ski boot into engagement with the toe piece 102.

Figure 7:
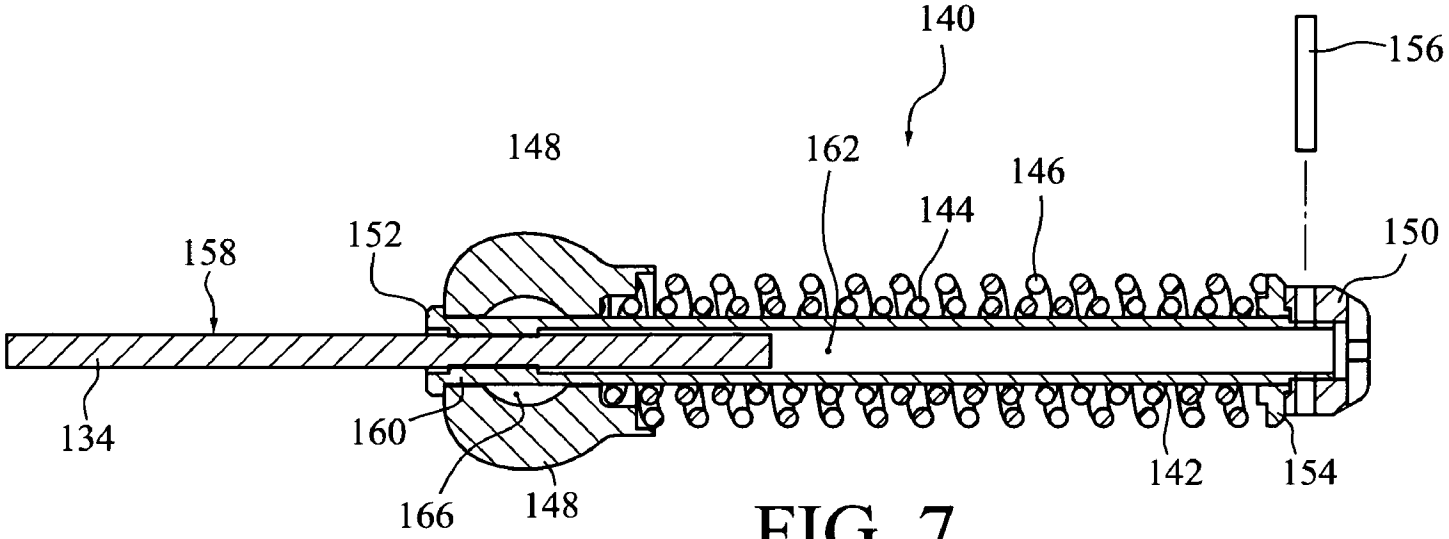
FIG. 7 is a cross-section view, partially exploded, taken through section 7-7 in FIG. 6.
Figure 6:
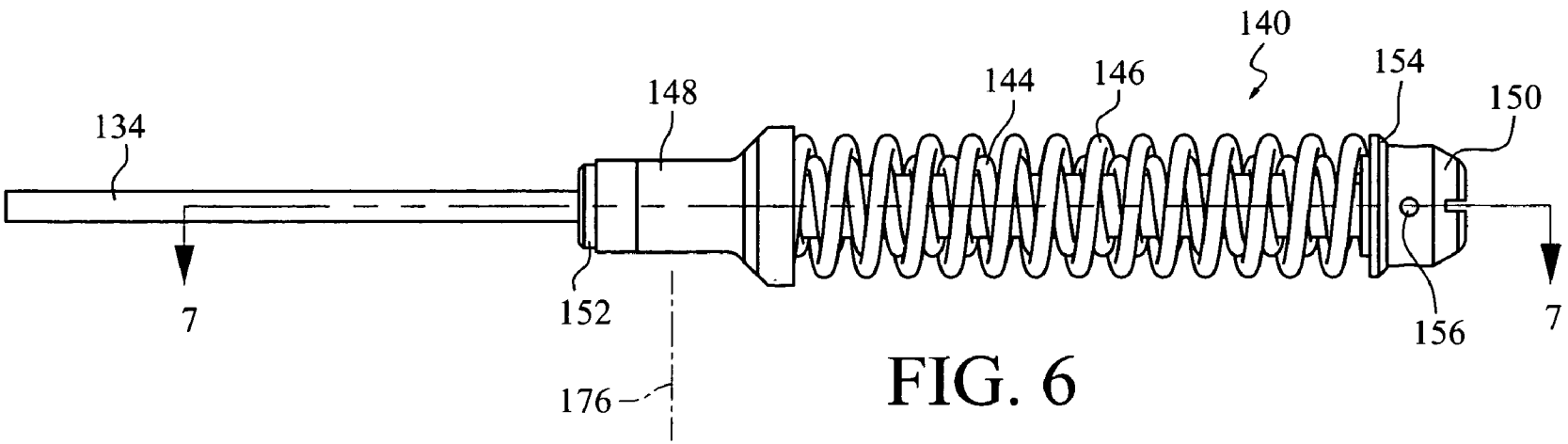
FIG. 6 is a top view of a spring assembly portion of the binding illustrated in FIG. 1.

With reference to FIGS. 6 and 7, a spring cartridge 140 includes a core 142 and a resilient element, or spring. In currently preferred arrangements the spring is a compression spring arranged substantially coaxially with, and exterior to, the core element. An exposed compression spring is inherently and advantageously self cleaning, as snow and ice are pressed out as the spring is compressed. However, arrangements including tension springs, or having a core disposed external to the spring element are workable in certain embodiments constructed according to principles of the invention. Spring cartridge 140 includes a pair of compression spring elements, including internal spring 144, and external spring 146. Desirably, springs 144 and 146 are of opposite hand to improve smoothness of action of the assembly 140. Use of a plurality of spring elements permits tailoring the load characteristics of a cartridge 140 to an enhanced degree over embodiments having only a single spring.

Cartridge 140 is pre-loaded, during manufacturing, by compressing springs 144 and 146 between adapter 148 and nut 150. As illustrated, a shoulder 152 disposed at one end of cylindrical core 142 engages adapter 148 to form a load platform on one side of the springs 144, 146. A cap 154 presses against the opposite side of springs 144, 146, and is axially retained on core 142 by nut 150 and pin 156. Cap 154 can be formed as a portion of nut 150 in an alternative arrangement. Also, nut 150 may alternatively be embodied as a type of locknut, or to include alternative arrangements to spring pin 156 effective to resist inadvertent disassembly of the cartridge 140.

A threaded portion, generally indicated at 158, of tension member 134 is received in correspondingly threaded entrance 160 of bore 162 inside core 142. Therefore, rotation of cap 150 is effective to adjust a spacing between a heel retainer 106 and the toe piece 102. The space between toe piece 102 and heel retainer 106 can easily be changed to adjust a binding 100 to fit any size of ski boot, simply by rotating nut 150 in the desired direction. Nut 150 may be used to adjust the relative position of heel retainer 106 with respect to toe piece 102 without changing the pre-load in the spring element(s).

As tension member 134 is loaded by a ski boot, core 142 is extracted from adapter 148 (to cause a spacing between adapter 148 and shoulder 152). The load caused by compressing the springs 144, 146 to extract the core is applied by adapter 148 to an alignment axle 164 (see FIG. 8), disposed in transverse aperture 166. The currently preferred embodiments of spring cartridge 140 provide approximately 2 inches of travel before the assembled spring elements 144, 146 are fully compressed to a solid cylinder. The arrangement of the core 142 and tension member 134 operates to urge an axis of spring elements 144, 146 into alignment with a direction of load applied by tension member 134.

Assembly steps for the heel retainer 106 will now be described with continued reference to FIG. 8. After placing an adapter 148 in position to receive pivot axle 164 in a transversely extending bore 166, a core 142 is inserted through the adapter 148, thereby placing a core 142 inside longitudinally extending bore 168. Assembly of springs 144, 146 and nut 150 then maintains the cartridge 140 engaged with axle 164. A spacer 170 is placed next to the first assembled spring cartridge 140, and a frame 172 and a frame filler 174, if desired, (see FIG. 1) are then slid into position on axle 164. A second spacer 170 is then slid into place onto axle 164 prior to installation of the second spring cartridge 140. The second spring cartridge 140 is assembled in like manner to the first spring cartridge 140.

A workable rear frame 172 is made by stamping and bending sheet Aluminum material into an elongated U-shape. A transverse bore is disposed at the top of the U, in which to receive the pivot axle 164. Frame 172 is therefore free to rotate about an alignment axis 176 associated with pivot axle 164. Other materials may be used to form a frame, nonexclusively including other metals such as steel, stainless steel, carbon fiber, and titanium, and certain sufficiently structural plastics.

Figure 10:
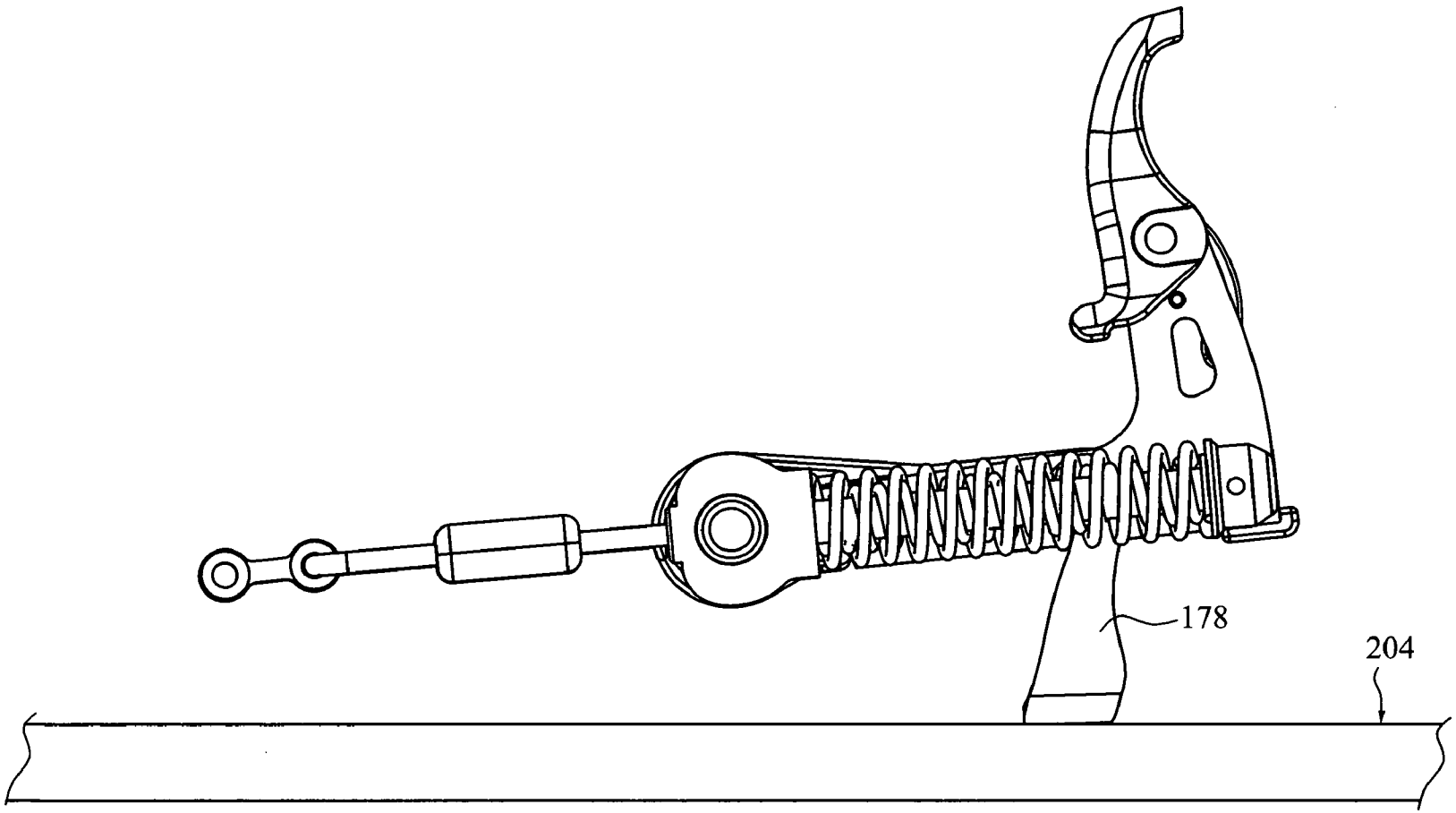
FIG. 10 is a side view of a heel retaining portion of the binding illustrated in FIG. 1, in combination with a ski and having the televator in a maximum extension position for climbing a grade.
Figure 11:
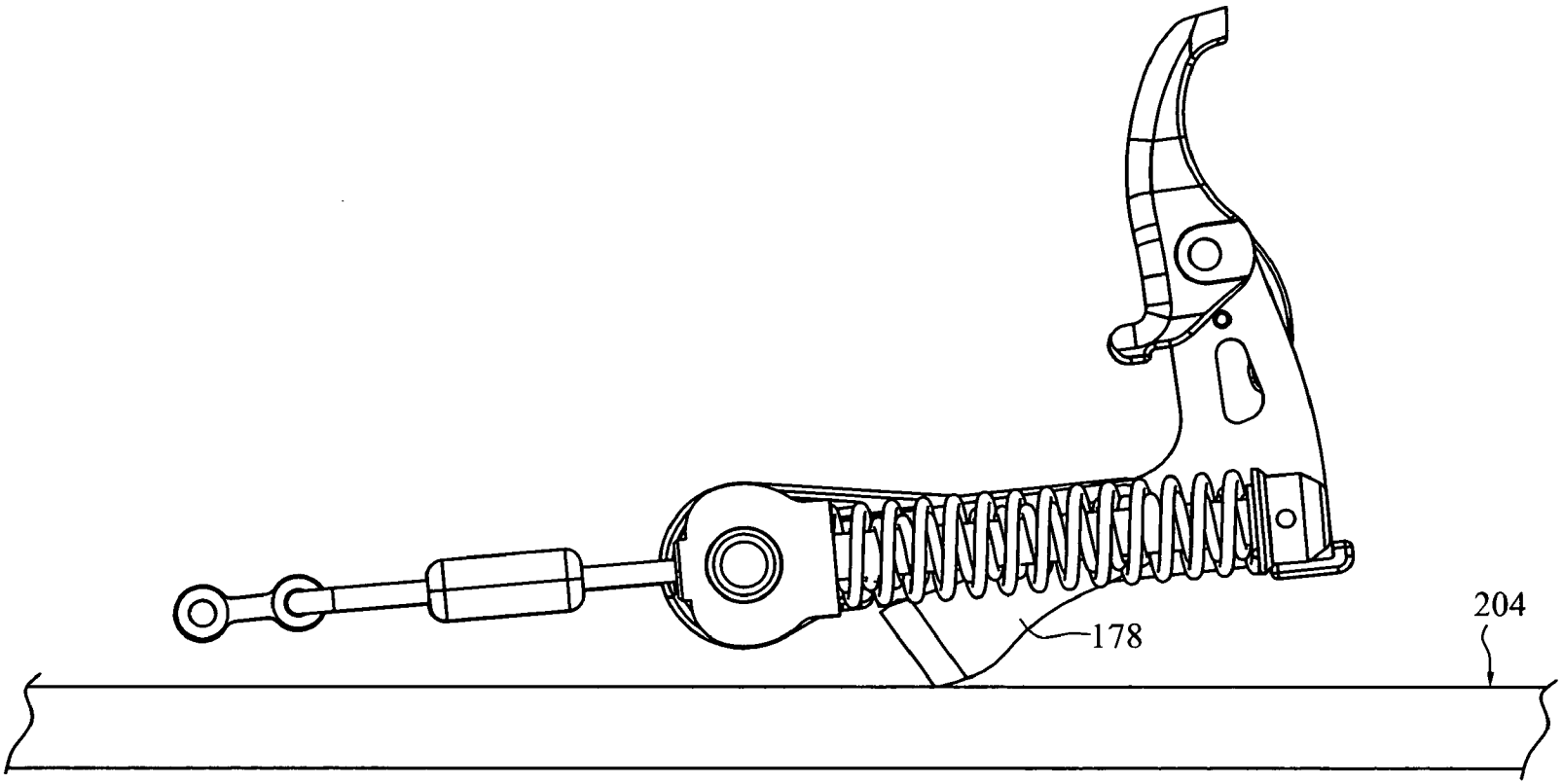
FIG. 11 is a side view of a heel retaining portion of the binding illustrated in FIG. 1, in combination with a ski and having the televator in a moderate extension position for climbing a grade.

The rear frame 172 desirably carries a televator, or climbing post 178, operable to assist a skier in climbing a grade. Televator 178 is mounted for rotation with respect to rear frame 172 about televator axle 179. The illustrated televator includes a biased pin 180 that is received in detent 182 to hold televator 178 at the stowed position illustrated in FIG. 8. One or more additional detent 184 may be provided to hold televator 178 at a different orientation effective (see FIGS. 10 and 11) to provide a heel support for a ski boot at one or more position elevated above a ski's top surface. Illustrated pin 180 is biased toward engagement with a detent by compression spring 186 disposed in frame filler 174 (see FIG. 4). Of course, other biasing arrangements are workable, including components having self-biasing elements.

A toggle lever 188 is carried by a pair of upstanding ears 190 of rear frame 172. Ears 190 form a spacer effective to hold pivot axis 192 of toggle lever 188 above a top surface of a ski to enable step-in assembly of a boot into the binding 100. It has been found convenient to include a torsion spring 194 to urge toggle lever 188 into the position illustrated in FIG. 8 so that shelf 196 is disposed to encounter the bottom of a ski boot's heel. At the position illustrated in FIGS. 8 and 9, the toggle lever 188 is in correct position to effect a step-in entry of a boot into the binding 100. As a boot heel steps onto shelf 196, the toggle lever begins an initial rotation to place hold-down prong 198 into reception in groove structure 200 of commercially available plastic ski boots. Certain embodiments of toggle lever 188 include an adjustable linkage operable to change the relative orientation of shelf 196 to hold-down prong 198, thereby to accommodate ski boot having different conformations of heel structure. The linkage can be adjusted so that shelf 196 encounters the sole sooner, or later, to provide more or less initial rotation of toggle lever 188 before engagement of hold-down prong 198 with the boot. It is also desirable to include a skid plate 202 arranged to provide a sliding interface, or to include some alternative structure, to resist damage to the ski's top surface 204 as a user steps into the binding 100. Typically, the heel retainer 106 slides rearward by about 0.1 inches to 0.3 inches during a step-in procedure.

Recall that the rear frame 172 is pivotally mounted about axis 176 through axle 164. Such an arrangement permits frame 172 to rotate, as indicated at 206, to provide a measure of accommodation for ski boot soles having different (non standard) groove-to-sole spacing. Toggle lever 188 is arranged to cause an over-center snap-through of hold-down prong 190 with respect to pivot axis 192 during the step-in procedure. "Over-center snaphthrough" means that hold-down prong 190 rotates past a central plane (containing pivot axis 192 and alignment axis 176) as a boot becomes engaged in the binding. In the case of a "thin" sole, toggle lever 188 will rotate slightly more to place groove 200 closer to the longitudinal rails of frame 172. Regardless of groove spacing (within reasonable limits), contact surface 208 is configured to provide load transfer between sole 210 and ski top surface 204. Contact surface 208 can include structure associated with one or more of adapters 148, frame 172, and frame filler 174.

Figure 8:
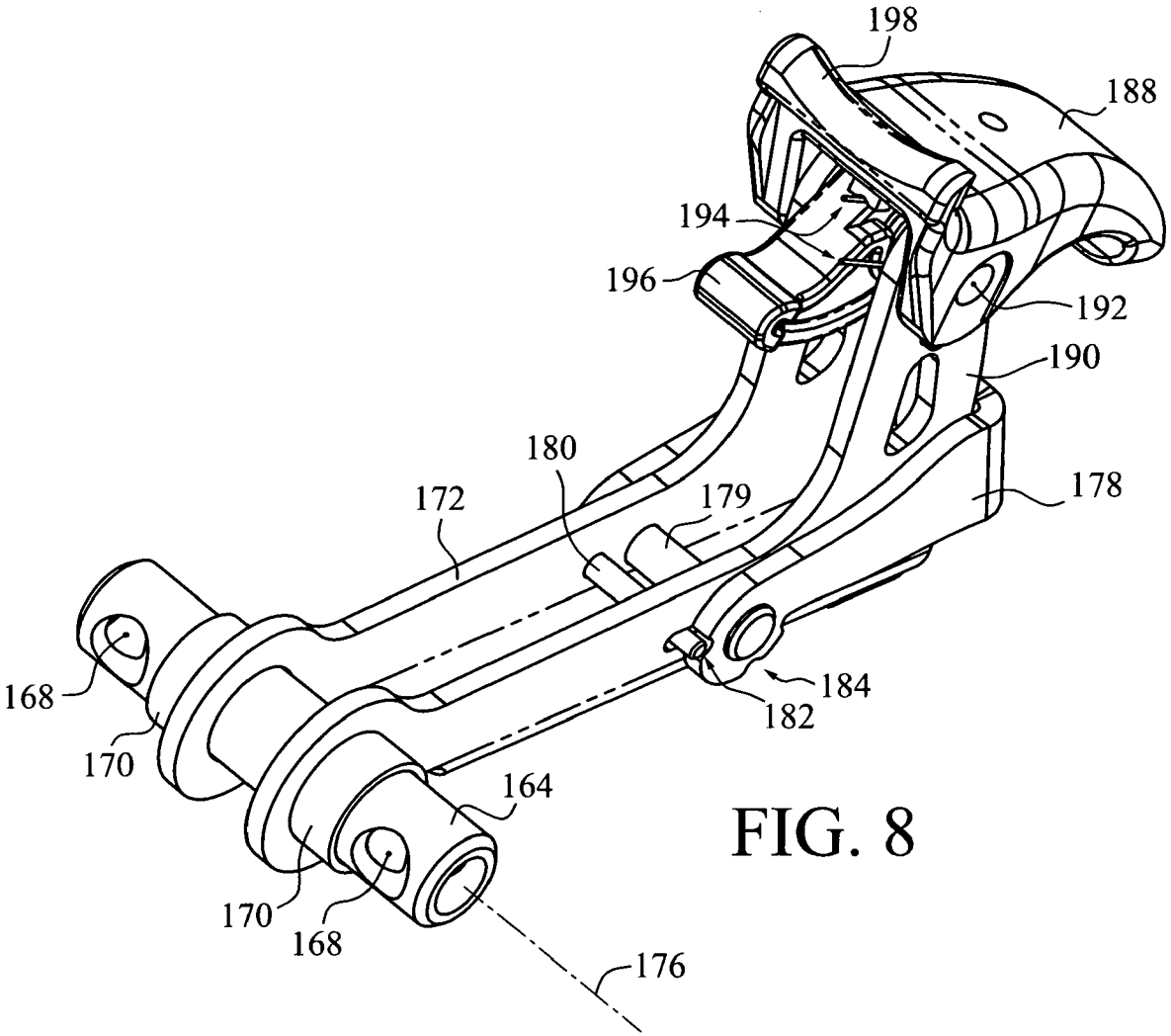
FIG. 8 is a view in perspective of a frame portion of the binding illustrated in FIG. 1.
Figure 9:
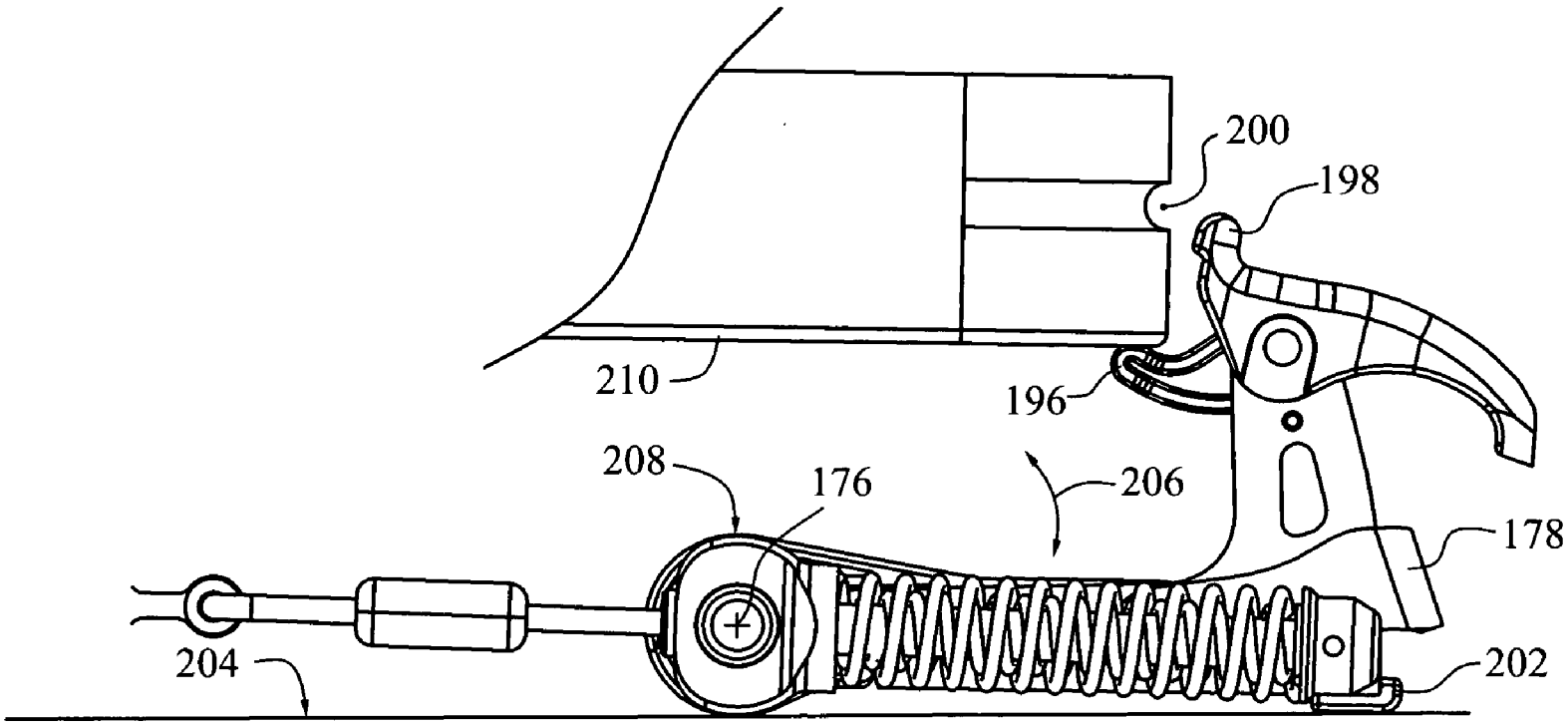
FIG. 9 is a side view of a heel retaining portion of the binding illustrated in FIG. 1, and a portion of a ski boot heel.

One advance provided in certain embodiments of the invention is attributable to the arrangement of an elongate frame disposed, under a heel of an installed ski boot, such as frame 172 illustrated in FIG. 8, in combination with pre-loaded spring assemblies. The combination affords a user a convenient step-in procedure to engage a ski boot into the binding. The pre-loaded spring cartridges place the spring(s) in a pre-loaded state, thereby reducing the amount of displacement required to sufficiently compress the springs by rotation of the toggle lever 188. Typically, the heel retainer 106 is mounted to cause between about 0.1 and 0.3 inches of additional spring compression when a boot is installed in a binding. Also, spacing structure, such as spacer portion 190, is important to locate pivot axle 192 at a distance from the ski's top surface so that a boot heel may be applied to cause rotation of lever 188.

In a currently preferred embodiment particularly useful in aggressive telemark skiing on packed snow conditions, individual cartridges 140 in a binding 100 are arranged to each produce about 20 to 40 pounds of force as a pre-load. Such pre-load is achieved through use of a pair of springs 144, 146, having individual spring constants that can be matched to a user's characteristics, such as weight and skiing ability. External spring 146 typically has a spring constant of about 55 lb/in. Internal springs 144 have been used having spring constants of about 15 lb/in, and 30 lb/in. The combinations produce an effective spring constant of about 70 lb/in and about 85 lb/in for each cartridge 140. A pre-load displacement of about 0.5 inches from spring free height is typically applied during assembly of a cartridge 140. A typical load of between about 50 to about 100 pounds is therefore applied to compress a ski boot installed in the binding 100 in a heel-down position. Since a raised boot heel may cause the cartridges to compress the springs by almost an additional 1.5 inches, it is possible to generate in excess of 300 pounds of compression load on the ski boot.

The linkage arrangement illustrated in FIG. 1 produces about a 2 inch long moment arm. Such moment arm, combined with a pair of relatively stiff spring cartridges 140, produces a sensation described as "snappy", and is preferred by some skiers, including certain telemark racers. The "snappy" feeling result from the heel of the ski boot being urged from an elevated position back toward engagement on the top surface of the ski. However, a corresponding effect is that the ski tip is also urged in a downward direction, potentially causing a phenomena known as "tip dive". Such "tip dive" is detrimental in certain situations, such as skiing or breaking trail in deep snow.

Spring cartridges similar to cartridges 140, but having lower effective spring rates are desirable in certain skiing situations to reduce "tip dive". Cartridges 140 having lower spring rates have beneficial application to back-country skiing, where "tip dive" is undesirable. Pre-loaded spring cartridges permit use of one or more contained springs having much lower spring constants, in combination with a larger pre-load displacement to produce an adequate load to hold a boot toe in a toe piece subsequent to step-in. Such lower effective spring constant produces a smaller increase in the load applied to the ski boot as the springs are further compressed. The load applied at the boots heel, and tendency to produce "tip dive", may also be reduced by modifying linkage 104 and frame 172 for use with a single spring cartridge to generate a lower compression load on the boot. Another way to reduce, or eliminate, "tip dive" is to reduce the offset, or moment arm, under the boot toe and between the line of action of a resisting load at the toe piece 102 and the line of action of the load generated at the heel retainer 106.

Figure 12:
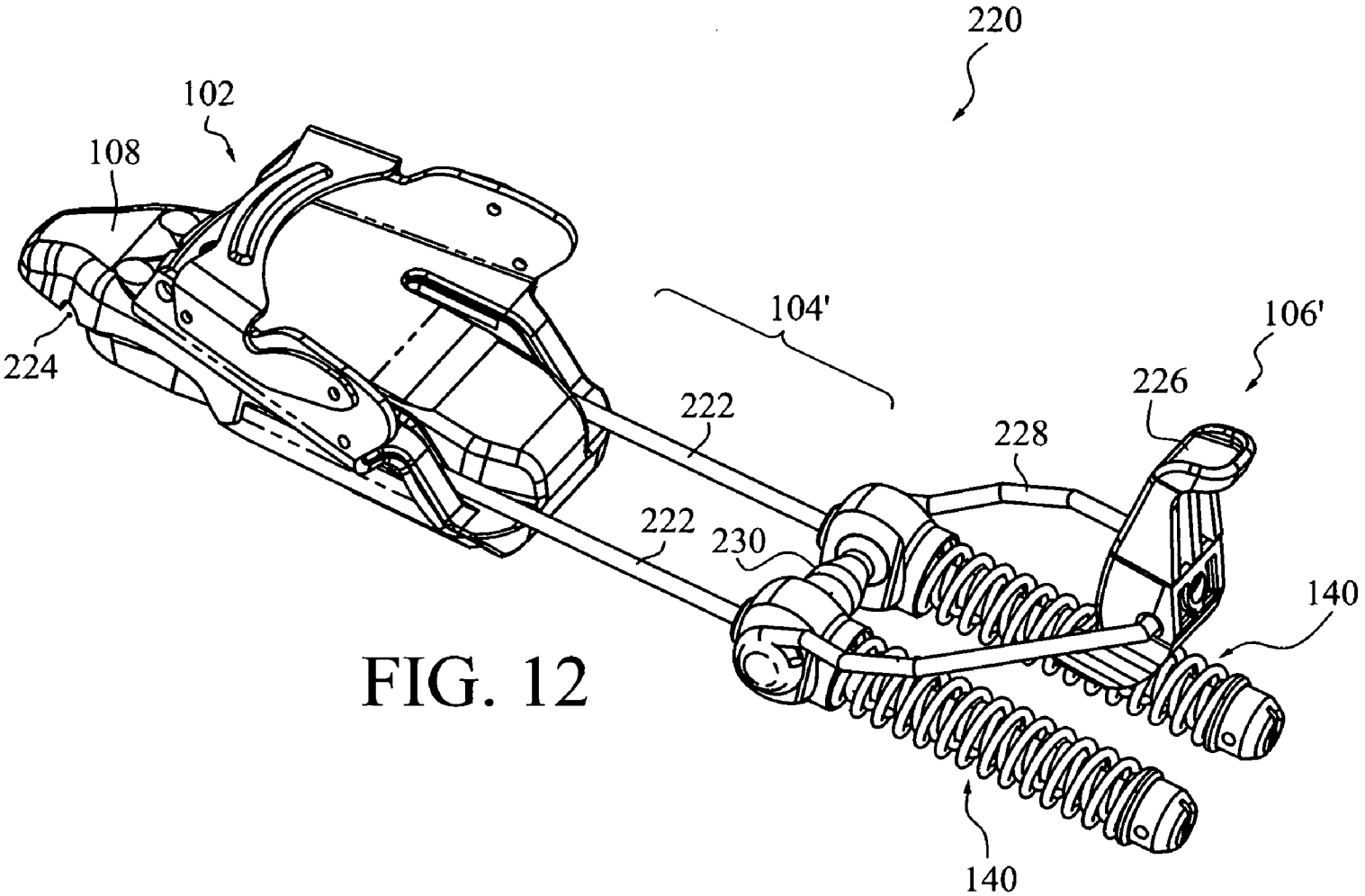
FIG. 12 is a view in perspective of a second embodiment of a cross-country type ski binding constructed according to principles of the invention.

One alternative embodiment constructed according to principles of the invention is generally indicated at 220 in FIG. 12. Binding 220 includes a toe piece 102, and alternatively structured linkage 104' and heel retainer 106'. Linkage 104' operates to associate the heel retainer 106' with toe piece 102. Linkage assembly 104' includes a pair of tension elements 222 that can be formed from cable material affixed to threaded ands for reception in spring assemblies 140. It is within contemplation for an alternative such linkage to be formed as a substantially U-shaped rigid link, such as a steel rod having threaded ends. A midspan of the cable portion of illustrated link 104' can be anchored by being trained through transverse groove 224 in forward shim 108.

Heel retainer 106' includes a rock-over heel lever 226 arranged through metal harness 228 to apply a load between a ski boot heel and ends of spring cartridges 140. In the illustrated binding 220, spring cartridge assemblies 140 are spaced apart by transverse axle 230.

Figure 13:
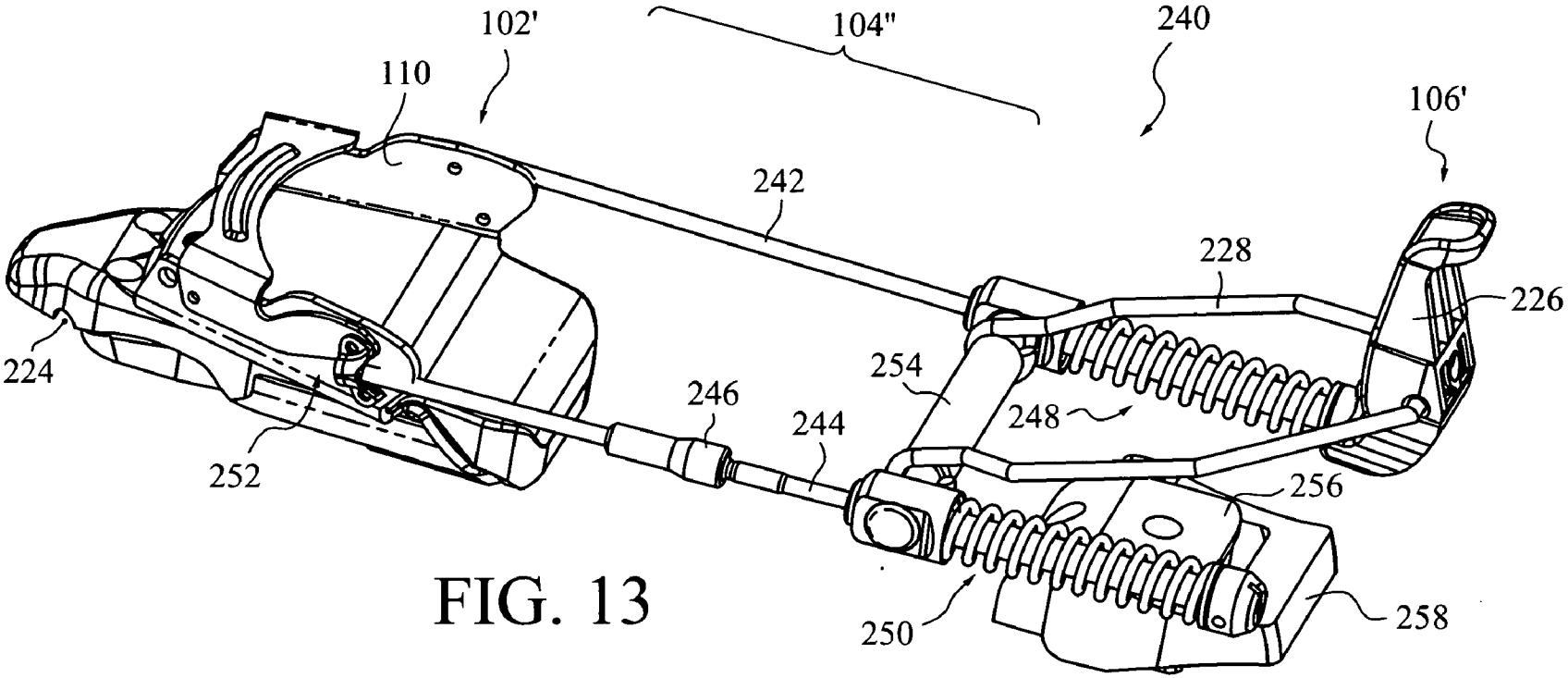
FIG. 13 is a view in perspective of a third embodiment of a cross-country type ski binding constructed according to principles of the invention.

A second alternative embodiment constructed according to principles of the invention is generally indicated at 240 in FIG. 13. Binding 240 includes alternatively structured toe piece 102' associated with heel retainer 106' through linkage 104". Linkage 104" includes a cable portion 242 and a threaded end 244. The cable portion and threaded end are joined at connector 246. The end of cable 242 opposite the threaded end can be threaded also, or simply provide a stopper element effective to load spring cartridge 248 effective to compress its contained spring element. In the latter case, adjustment of spacing between toe piece 102' and heel retainer 106' is effected imply be rotating spring cartridge 250. An anchor for a mid span portion of cable 242 may be provided by training cable 242 through structure associated with the forward shim, such as transverse slot 224. The full length of cable 242 is not illustrated (at its midspan), to better illustrate potential anchor structure provided by the forward shim 108.

Binding 240 is arranged to minimize a "tip dive" producing moment applied to the ski when a ski boot heel is in an elevated position. A pivot anchor for linkage 104" is indicated generally at 252, and is elevated from the top of the ski to orient the cable's load path through the toe of the ski boot. Such an arrangement generally minimizes a moment arm, and thereby reduces or eliminates a "tip dive" inducing moment applied to the ski by raising a boot heel from the top surface of the ski.

It is within contemplation for pivot anchor 252 to provide direct anchor locations for cable 242 disposed on opposite sides of toe plate 110. In such case, a threaded end 244 would be included on each side of the binding to permit adjustment of spring cartridge spacing from toe piece 102'.

Axle 254 serves as an under-sole spacer between spring cartridge 248 and spring cartridge 250. Binding 240 also include a rear shim 256 to elevate a heel of a ski boot in conformance with an elevation of toe piece 102'. Illustrated rear shim 256 carries televator 258 adapted to assist a skier while climbing a grade.

While the instant invention has been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. The scope of the instant invention is, therefore, indicated by the appended claims rather than by the foregoing description. All changes which come within the meaning and range of equivalency of the claims are to be embraced within their scope.

What is claimed is:

1. In a ski binding adapted to maintain the toe of a ski boot in association with a ski while permitting the heel of the ski boot to elevate with respect to a top surface of the ski, the improvement comprising:

a linkage assembly disposed in association between:

a toe piece arranged to hold a toe portion of a ski boot; and a heel retainer configured and arranged for engagement with structure associated with a heel portion of said ski boot; wherein:

said linkage assembly is adapted to bias said heel retainer effective, when said ski boot is installed in said binding, to urge said toe portion of said ski boot toward contact with structure associated with said toe piece; and said linkage assembly comprises a pre-loaded spring assembly, wherein said spring assembly comprises:

a core adapted for attachment to structure of said linkage assembly; and a first compression spring mounted substantially coaxially with, and external to, said core and disposed in a state of compression prior to installation of said ski boot into said binding.

2. The improvement according to claim 1, wherein:

said core is attached to tension structure of said linkage assembly operably to vary a spacing between said heel retainer and said toe piece.

3. The improvement according to claim 1, wherein:

an amount of pre-load in said first compression spring is fixed upon factory assembly of said ski binding.

4. The improvement according to claim 1, wherein:

an amount of pre-load in said first compression spring is user adjustable.

5. The improvement according to claim 2, wherein:

said core is configured and arranged in harmony with structure of said linkage assembly operably to urge an alignment of an axis of said first compression spring with the direction of a load applied by said tension structure.

6. The improvement according to claim 1, further comprising:

a second compression spring mounted substantially coaxially with, and external to, said core.

7. The improvement according to claim 6, wherein:

said first compression spring and said second compression spring are of opposite hand.

8. In a ski binding adapted to maintain the toe of a ski boot in association with a ski while permitting the heel of the ski boot to elevate with respect to a top surface of the ski, the improvement comprising:

a linkage assembly disposed in association between:

a toe piece arranged to hold a toe portion of a ski boot; and a heel retainer configured and arranged for engagement with structure associated with a heel portion of said ski boot; wherein:

said linkage assembly is adapted to bias said heel retainer effective, when said ski boot is installed in said binding, to urge said toe portion of said ski boot toward contact with structure associated with said toe piece; and said linkage assembly comprises a pre-loaded spring assembly, wherein:

said heel retainer comprises a toggle lever configured to permit step-in installation of said ski boot, wherein;

when said ski boot is disposed for installation in said binding, simply lowering a heel of said ski boot is sufficient to cause said toggle lever to rotate past an over-center condition effective to engage said boot in said binding.

9. The improvement according to claim 8, wherein:

said toggle lever is mounted for rotation about a pivot axis that is oriented by a spacer effective to maintain at least a minimum offset between said pivot axis and a top surface of a ski on which said binding is mounted, said toggle lever comprising:

a step-in shelf arranged to interact with a heel of said ski boot operably to initiate rotation of said toggle lever during said step-in installation; and a hold-down prong configured in harmony with said step-in shelf to engage groove structure associated with a heel area of a commercially available plastic ski boot operably to continue rotation of said toggle lever to effect over-center displacement of said hold-down prong.

10. The improvement according to claim 9, wherein:

an orientation of said step-in shelf with respect to said hold-down prong is user adjustable to accommodate ski boots having different sole thicknesses.

11. In a ski binding adapted to maintain the toe of a ski boot in association with a ski while permitting the heel of the ski boot to elevate with respect to a top surface of the ski, the improvement comprising:

a linkage assembly disposed in association between:

a toe piece arranged to hold a toe portion of a ski boot; and a heel retainer configured and arranged for engagement with structure associated with a heel portion of said ski boot; wherein:

said linkage assembly is adapted to bias said heel retainer effective, when said ski boot is installed in said binding, to urge said toe portion of said ski boot toward contact with structure associated with said toe piece; and said linkage assembly comprises a pre-loaded spring assembly, wherein:

said linkage assembly is arranged to dispose a frame in association with said pre-loaded spring assembly operably to locate said pre-loaded spring assembly substantially under a heel portion of an installed said ski boot;

said frame carries a toggle lever mounted for rotation about a pivot axis that is oriented by a spacer effective to maintain at least a minimum offset between said pivot axis and a top surface of a ski on which said binding is mounted; and said frame is rotatable about an alignment pivot axis to effect an automatic adjustment to accommodate ski boots having different sole thickness.

12. In a ski binding adapted to maintain the toe of a ski boot in association with a ski while permitting the heel of the ski boot to elevate with respect to a top surface of the ski, the improvement comprising:

a linkage assembly disposed in association between:

a toe piece arranged to hold a toe portion of a ski boot; and a heel retainer configured and arranged for engagement with structure associated with a heel portion of said ski boot; wherein:

said linkage assembly is adapted to bias said heel retainer effective, when said ski boot is installed in said binding, to urge said toe portion of said ski boot toward contact with structure associated with said toe piece; and said linkage assembly comprises a pre-loaded spring assembly, wherein:

said linkage assembly is arranged to dispose a frame in association with said pre-loaded spring assembly operably to locate said pre-loaded spring assembly substantially under a heel portion of an installed said ski boot;

said frame carries a toggle lever mounted for rotation about a pivot axis that is oriented by a spacer effective to maintain at least a minimum offset between said pivot axis and a top surface of a ski on which said binding is mounted; and said frame carries a climbing post operable to establish a load bearing platform for a heel of said ski boot at a location elevated from said top surface of said ski.

13. In a ski binding adapted to maintain the toe of a ski boot in association with a ski while permitting the heel of the ski boot to elevate with respect to a top surface of the ski, the improvement comprising:

a linkage assembly disposed in association between:

a toe piece arranged to hold a toe portion of a ski boot; and a heel retainer configured and arranged for engagement with structure associated with a heel portion of said ski boot; wherein:

said linkage assembly is adapted to bias said heel retainer effective, when said ski boot is installed in said binding, to urge said toe portion of said ski boot toward contact with structure associated with said toe piece; and said linkage assembly comprises a pre-loaded spring assembly, wherein:

said linkage assembly is configured and arranged to facilitate a step-in procedure by urging said heel retainer into registration within a zone over a top surface of said ski to permit direct step-in engagement of said ski boot, wherein;

when said ski boot is disposed for installation in said binding, lowering a heel of said ski boot is sufficient to cause a toggle lever portion of said heel retainer to rotate past an over-center condition effective to engage said boot in said binding without requiring manual manipulation of said heel toggle lever.

14. The improvement according to claim 13, wherein said linkage assembly comprises:

a forward tension member disposed for rotation between an anchor axis and a first intermediate axis;

a link disposed for rotation between said first intermediate axis and a second intermediate axis; and a rear tension member disposed for rotation about said second intermediate axis.

15. In a ski binding that is adapted to permit a skier, while in the act of skiing, to raise the heel of a ski boot, which is installed in the binding, in a direction substantially normal to a top surface of a ski on which the binding is mounted, the improvement comprising:

a linkage assembly disposed in association between:

a toe piece arranged to hold a toe portion of a ski boot; and a heel retainer configured and arranged for engagement with structure associated with a heel portion of said ski boot; wherein:

said linkage assembly is adapted to bias said heel retainer effective, when said ski boot is installed in said binding, to urge said toe portion of said ski boot toward contact with structure associated with said toe piece; and said linkage assembly comprises:

a forward tension member disposed for rotation between an anchor axis and a first intermediate axis;

a link disposed for rotation between said first intermediate axis and a second intermediate axis; and a rear tension member disposed for rotation about said second intermediate axis; wherein:

said forward tension member, said link, and said rear tension member are configured and arranged in harmony to resist transverse displacement of said heel retainer.

16. In a ski binding that is adapted to permit a skier, while in the act of skiing, to raise the heel of a ski boot, which is installed in the binding, in a direction substantially normal to a top surface of a ski on which the binding is mounted, the improvement comprising:

a linkage assembly disposed in association between:

a toe piece arranged to hold a toe portion of a ski boot; and a heel retainer configured and arranged for engagement with structure associated with a heel portion of said ski boot, said heel retainer comprising a frame carrying a toggle lever rotatably mounted on structure defining a spaced apart relationship between a pivot axis of said toggle lever and a reference plane effective to provide a step-in capability for said binding; wherein:

said linkage assembly is adapted to bias said heel retainer effective, when said ski boot is installed in said binding, to urge said toe portion of said ski boot toward contact with structure associated with said toe piece.

17. The improvement according to claim 16, wherein:

structure associated with said frame is configured to form a support surface disposed under a heel of an installed ski boot;

said support surface is spaced apart from a top surface of said ski to an elevation in harmony with an elevation of an installed said toe piece, said support surface thereby operating as a rear shim for said installed ski boot; and said linkage system is arranged to permit adjustment of a spacing between said toe piece and said frame effective to dispose said support surface at an operable position, regardless of a length of said installed ski boot.

18. The improvement according to claim 16, wherein:

said frame carries televator structure operable to space said heel retainer apart from said top surface of said ski to assist a skier in climbing a steep grade.

19. The improvement according to claim 16, wherein:

said frame is rotatable about a transversely oriented alignment pivot axis to effect an automatic adjustment to accommodate a plurality of ski boots having differently sized spacing between a boot-heel bottom surface and receiving structure adapted to engage a hold-down prong of said toggle lever.

* * * * *